US008684754B1

(12) United States Patent
Lai

(10) Patent No.: US 8,684,754 B1
(45) Date of Patent: Apr. 1, 2014

(54) PLUG AND SOCKET CONVERTIBLE ELECTRICAL CONNECTOR ASSEMBLY

(75) Inventor: Chyi-Lang Lai, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 13 days.

(21) Appl. No.: 13/620,073

(22) Filed: Sep. 14, 2012

(51) Int. Cl.
*H01R 13/44* (2006.01)

(52) U.S. Cl.
USPC ..... 439/131

(58) Field of Classification Search
USPC ..... 439/131, 132, 172, 136, 176
See application file for complete search history.

(56) References Cited

U.S. PATENT DOCUMENTS 6,922,666 B2 * 7/2005 Noyes ..... 703/26
7,035,126 B1 * 4/2006 Lanni ..... 363/142
7,134,887 B1 * 11/2006 Keely ..... 439/131
8,491,317 B2 * 7/2013 Vardanyan ..... 439/131

* cited by examiner

*Primary Examiner* — Phuong Dinh
(74) *Attorney, Agent, or Firm* — Muncy, Geissler, Olds & Lowe, P.C.

(57) ABSTRACT

A plug and socket convertible electrical connector assembly including a connector body and a slide cover is disclosed. The connector body includes a housing defining an oblong insertion opening and multiple insertion slots at two adjacent walls thereof, a rack mounted in the housing, an electrical socket mounted in the rack and aimed at the insertion opening. The slide cover carrying multiple metal conducting blades is mounted in the housing and movable between a received position where the insertion opening is opened for allowing insertion of an external power adapter cable into the electrical socket, and an extended position where the slide cover blocks the insertion opening and the metal conducting blades are extended out of the insertion slots for connection to a city power supply outlet.

7 Claims, 7 Drawing Sheets

PLUG AND SOCKET CONVERTIBLE ELECTRICAL CONNECTOR ASSEMBLY

BACKGROUND OF THE INVENTION

1. Field of the Invention

The present invention relates to electrical connector technology and more particularly, to a plug and socket convertible electrical connector assembly, which can be selectively set between a socket form or a plug form for different power input applications and, which has compact size and enhanced safety characteristics.

2. Description of the Related Art

Following fast development of the modern technology and electronic industry, many different kinds of consumer electronics such as computer, notebook computer, PDA (personal digital assistant), cell phone and other computer peripheral devices are created, bringing convenience to people. In the recent years, the electronic products have a tendency toward light, thin, short and small and a variety of functions. In order to minimize the device dimension, internal components for electronic devices must be made having the characteristics of small size, high precision and high durability. Further, when using an electronic device, a power adapter may be necessary for providing power supply to the electronic device or charging the built-in battery of the electronic device.

FIG. 7 illustrates a conventional power adapter arrangement for notebook computer. As illustrated, this power adapter arrangement comprises a transformer B for converting AC to DC, a power adapter cable A having a connector A2 provided at its one end for detachably connection to a power jack B1 at one side of the transformer B and an electrical plug A1 provided at its opposite end for connection to a city power supply outlet, and a power output cable C extended from an opposite side of the transformer B for outputting converted DC power supply to a notebook computer. The electrical plug A1 of the power adapter cable A has a particular specification for use in specific countries. For use in other countries employing different specifications, different power adapter cables A with a respective different type of electrical plug A1 shall be selectively provided. It is inconvenient to prepare and carry many different power adapter cables A when travelling abroad. An improvement in this regard is necessary.

SUMMARY OF THE INVENTION

The present invention has been accomplished under the circumstances in view. It is therefore the main object of the present invention to provide a plug and socket convertible electrical connector assembly, which can be selectively set between a socket form or a plug form for different power input applications. It is another object of the present invention to provide a plug and socket convertible electrical connector assembly, which has compact size and enhanced safety characteristics.

To achieve these and other objects of the present invention, a plug and socket convertible electrical connector assembly comprises a connector body and a slide cover. The connector body comprises a housing defining an oblong insertion opening and multiple insertion slots at two adjacent walls thereof, a rack mounted in the housing, an electrical socket mounted in the rack and aimed at the insertion opening. The slide cover is mounted in the housing and holds a plurality of metal conducting blades. Further, the slide cover can be moved relative to the connector body between a received position where the insertion opening is opened for allowing insertion of an external power adapter cable into the electrical socket, and an extended position where the slide cover blocks the insertion opening and the metal conducting blades are extended out of the insertion slots for connection to a city power supply outlet.

The metal conducting blades of the slide cover and the electrical socket are arranged using a space overlapping technique, and therefore, the dimension of the connector body is minimized. Due to compact size of the connector body, the material cost for the housing is cheap.

Further, the metal conducting blades and the electrical socket are arranged in the connector body for selective use, enhancing application convenience.

Further, when the metal conducting blades are extended out of the insertion slots of the housing for connection to a city power supply outlet, the oblong insertion opening of the housing is blocked by the slide cover, and the electrical socket is kept from sight and well protected against insertion of an external object, avoiding accidental short circuits.

DETAILED DESCRIPTION OF THE PREFERRED EMBODIMENT

Figure 1:
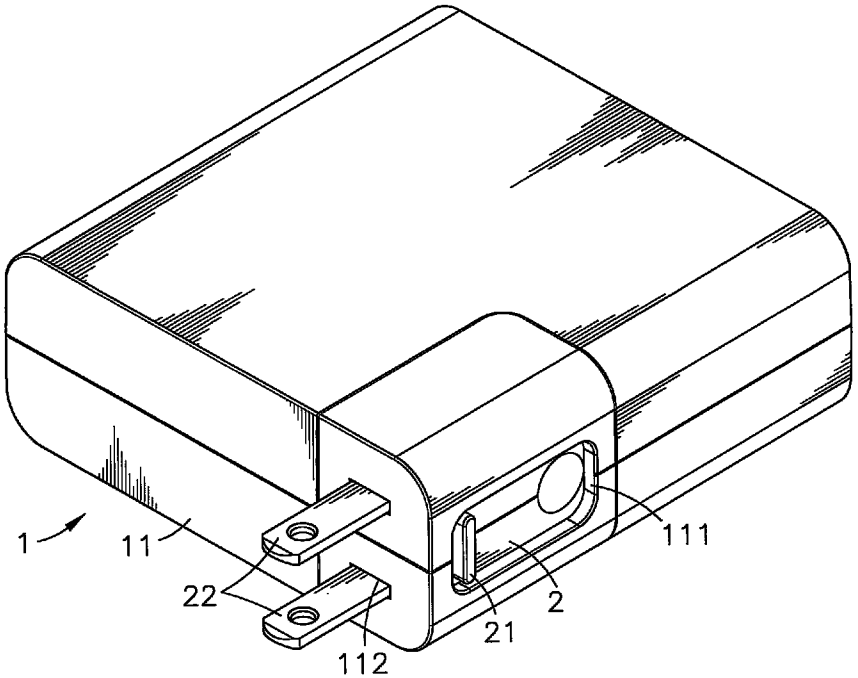
FIG. 1 is an elevational view of a plug and socket convertible electrical connector assembly in accordance with the present invention.
Figure 2:
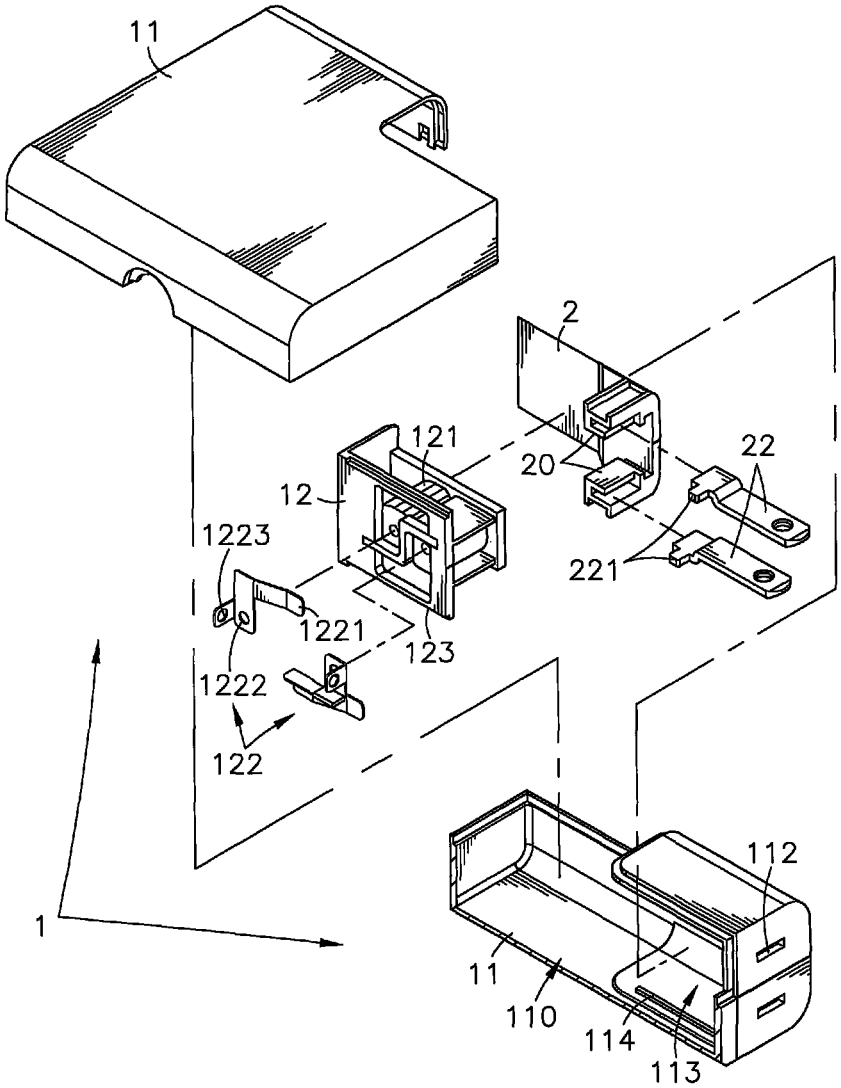
FIG. 2 is an exploded view of the plug and socket convertible electrical connector assembly in accordance with the present invention.
Figure 3:
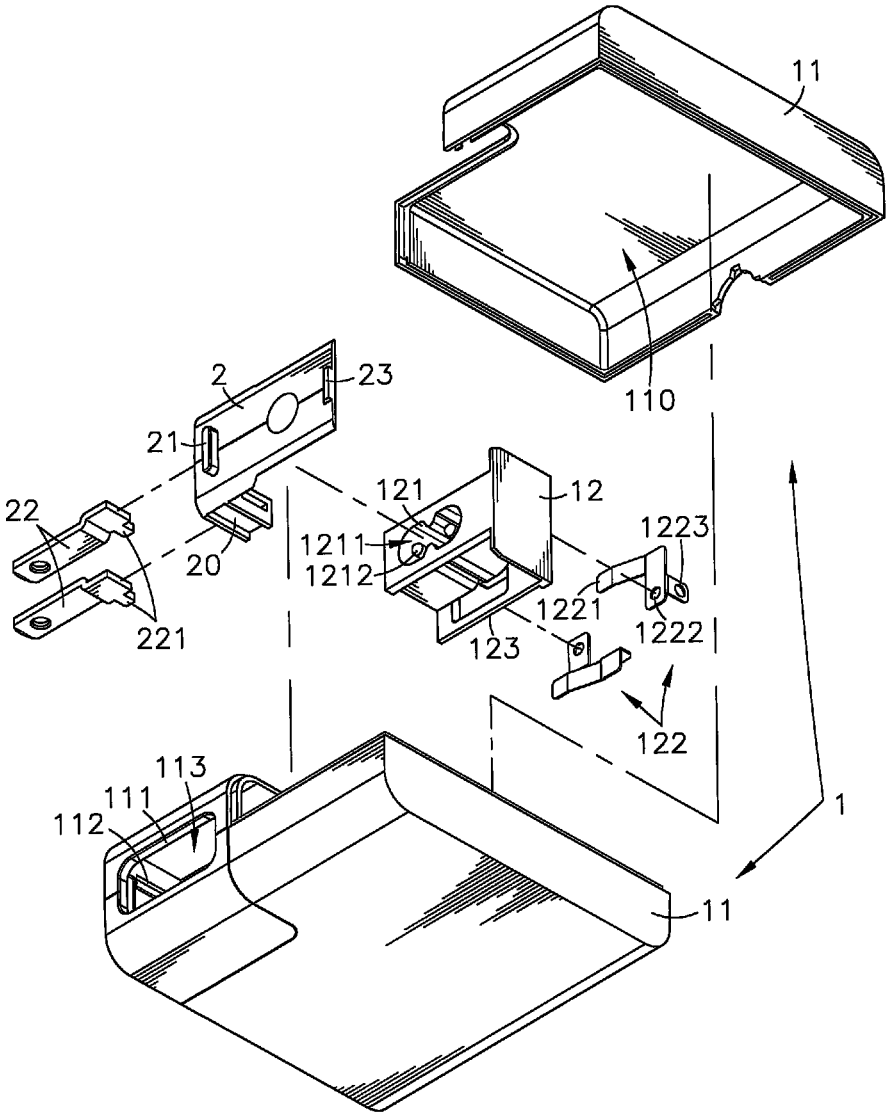
FIG. 3 is another exploded view of the plug and socket convertible electrical connector assembly in accordance with the present invention.

Referring to FIGS. 1, 2 and 3, a plug and socket convertible electrical connector assembly in accordance with the present invention is shown. The plug and socket convertible electrical connector assembly comprises a connector body 1 and a slide cover 2.

The connector body 1 comprises a housing 11 defining therein an accommodation chamber 110. The housing 11 comprises an oblong insertion opening 111 located on one sidewall thereof, a locating groove 1101 located on an inside wall thereof adjacent to one side of the oblong insertion opening 111, a plurality of, for example, two insertion slots 112 located on an adjacent sidewall thereof, a compartment 113 defined in a corner area in the accommodation chamber 110 and abutted to the oblong insertion opening 111 and the insertion slots 112, two sliding rails 114 mounted in the compartment 113 in a parallel manner, a rack 12 slidably accommodated in the compartment 113 and comprising two sliding grooves 123 respectively slidably coupled to the sliding rails 114, an electrical socket 121, which is fixedly mounted in the rack 12 and aimed at the oblong insertion opening 111, comprising a mating hole 1211 and two conducting contacts 1212 fixedly suspending in the mating hole 1211, and two conducting terminals 122 mounted at one side of the rack 12 and spaced apart. The conducting terminals 122 each comprise a first contact 1221, a second contact 1222 and a third contact 1223. The second contacts 1222 of the conducting terminals 122 are respectively electrically connected to the conducting contacts 1212 of the electrical socket 121. The third contacts 1223 of the conducting terminals 122 are respectively electrically connected to an internal circuit of a predetermined electronic device (not shown).

The slide cover 2 is mounted in the housing 11 of the connector body 1 between the oblong insertion opening 111 and the electrical socket 121 in the rack 12, comprising a stop block 21 and a retaining block 23 protruded from an outer wall thereof at opposing front and rear sides, two support arms 20 backwardly extended from an inner wall thereof, and two metal conducting blades 22 respectively affixed to the support arms 20 and extended from the support arms 20 in direction toward the insertion slots 112 of the housing 11. The stop block 21 of the slide cover 2 is coupled to and movable along the oblong insertion opening 111. Each metal conducting blade 22 comprises a rear contact portion 221 disposed adjacent to the respective support arm 20.

Figure 4:
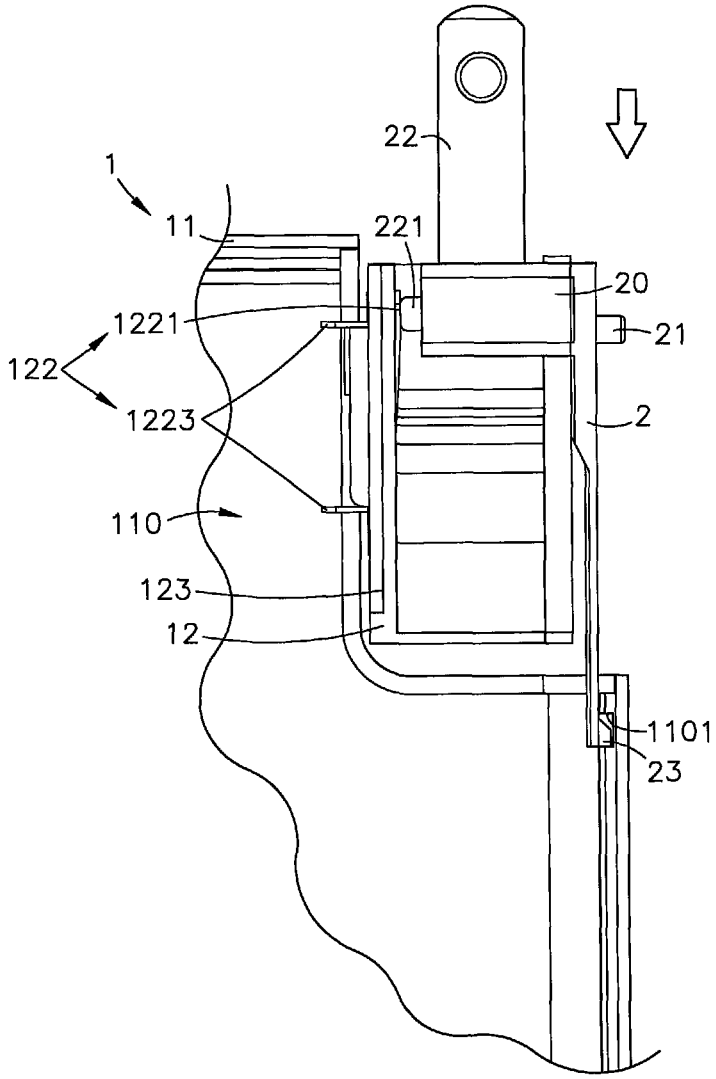
FIG. 4 is a schematic sectional side view of the present invention, illustrating the slide cover in the extended position and the two metal conducting blades extended out of the insertion slots of the housing.
Figure 5:
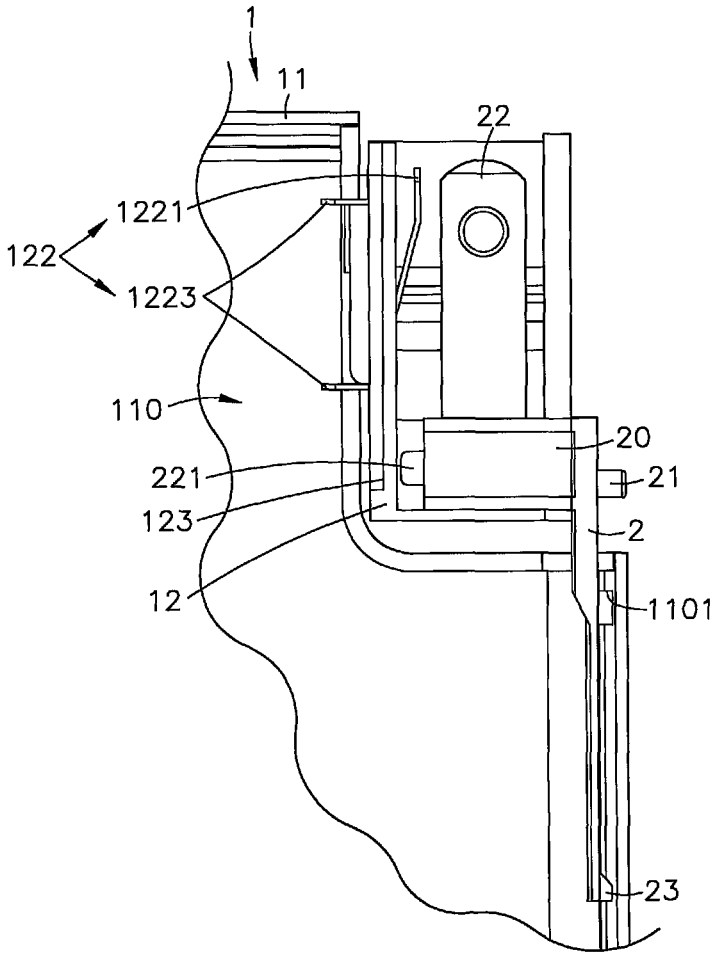
FIG. 5 is a schematic sectional side view of the present invention, illustrating the slide cover in the received position and the two metal conducting blades received inside the insertion slots of the housing.
Figure 6:
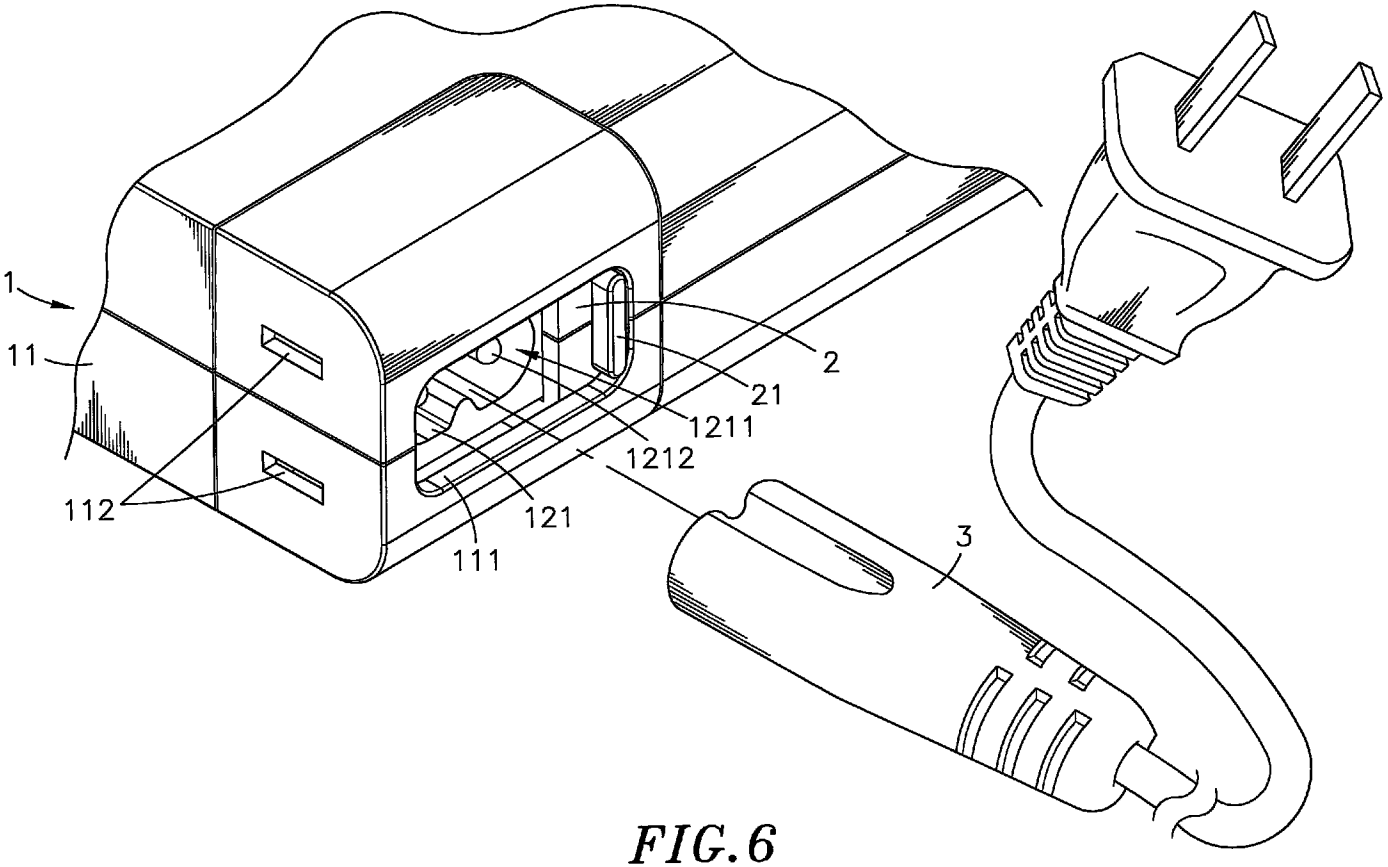
FIG. 6 is an elevational view of the present invention, illustrating the slide cover in the received position and the mating hole of the electrical socket exposed to the oblong insertion opening for the insertion of an external power adapter cable.
Figure 7:
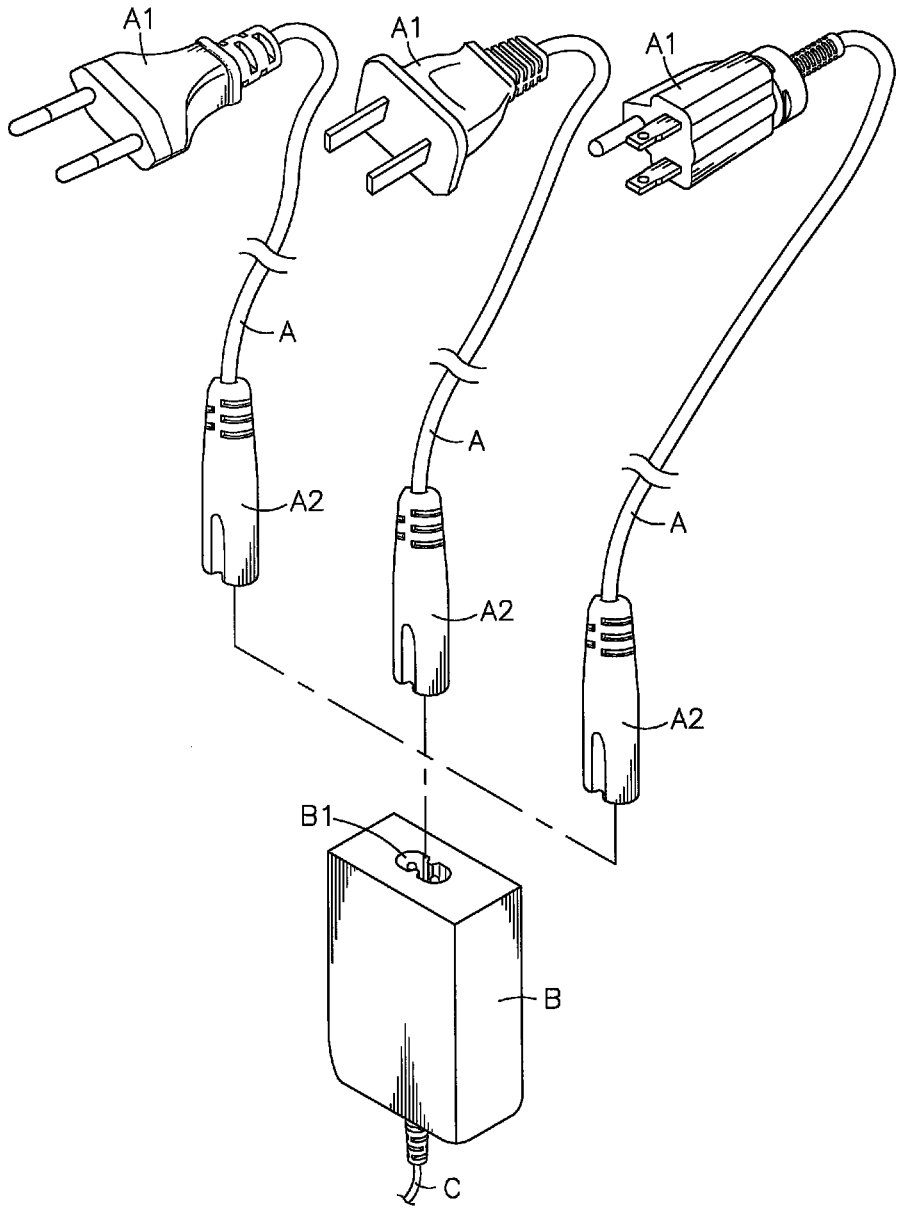
PRIOR ART FIG.7
FIG. 7 is a schematic drawing illustrating a power adapter arrangement for notebook computer according to the prior art.

Referring to FIGS. 4, 5 and 6, the slide cover 2 is movable along the oblong insertion opening 111 between a received position and an extended position. When the slide cover 2 is in the received position, the two metal conducting blades 22 of the slide cover 2 are respectively received inside the insertion slots 112 of the housing 11, and the stop block 21 of the slide cover 2 is stopped at one side of the oblong insertion opening 111. At this time, a power adapter cable 3 can be inserted through the oblong insertion opening 111 into the mating hole 1211 of the electrical socket 121 to electrically conduct the conducting contacts 1212 for power input.

On the contrary, when the slide cover 2 is in the extended position, the oblong insertion opening 111 is blocked by the slide cover 2, the two metal conducting blades 22 of the slide cover 2 are respectively forced out of the insertion slots 112 of the housing 11, the stop block 21 of the slide cover 2 is stopped at an opposite side of the oblong insertion opening 111, and the retaining block 23 is forced into engagement with the locating groove 1101. At this time, the rear contact portions 221 of the metal conducting blades 22 are kept in contact with the first contacts 1221 of the conducting terminals 122. Thus, the user can insert the metal conducting blades 22 into a city power supply outlet (not shown) to receive city power supply.

Further, when the metal conducting blades 22 are extended out of the insertion slots 112 of the housing 11 for insertion into a city power supply outlet, the slide cover 2 blocks the oblong insertion opening 111 of the housing 11, and the electrical socket 121 is kept from sight, i.e., the conducting contacts 1212 of the electrical socket 121 is well protected against insertion of an external object, avoiding accidental short circuits.

Further, the metal conducting blades 22 can be selectively configured subject to any of a variety of specifications to fit different countries, i.e., the metal conducting blades 22 can be configured to fit the related specifications of the user's country for direct application without any power adapter cable 3.

As stated above, the slide cover 2 can be moved in the housing 11 of the connector body 1 between an extended position and a received position to open or close the oblong insertion opening 111. When the slide cover 2 is in the received position to open the oblong insertion opening 111, the electrical socket 121 is exposed to the outside for the connection of a power adapter cable 3. When the slide cover 2 is in the extended position to close the oblong insertion opening 111, the metal conducting blades 22 of the slide cover 2 are extended out of the insertion slots 112 of the housing 11 for connection to a city power supply outlet.

In actual application, the plug and socket convertible electrical connector assembly has the features and advantages as follows:

1. The metal conducting blades 22 of the slide cover 2 and the electrical socket 121 are arranged using a space overlapping technique, minimizing the dimension of the connector body 1.
2. The metal conducting blades 22 and the electrical socket 121 are arranged in the connector body 1 for selective use, enhancing application convenience.
3. Due to compact size of the connector body 1, the material cost for the housing 11 is cheap.
4. When the metal conducting blades 22 are extended out of the insertion slots 112 of the housing 11 for connection to a city power supply outlet, the oblong insertion opening 111 of the housing 11 is blocked by the slide cover 2, and the electrical socket 121 is kept from sight and well protected against insertion of an external object, avoiding accidental short circuits.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A plug and socket convertible electrical connector assembly, comprising:

a connector body comprising a housing defining therein an accommodation chamber, said housing comprising an oblong insertion opening located on one sidewall thereof, a locating groove located on an inside wall thereof at adjacent to one side of said oblong insertion opening, a plurality of insertion slots located on an adjacent sidewall thereof, a rack slidably accommodated in said accommodation chamber, an electrical socket fixedly mounted in said rack and aimed at said oblong insertion opening, said rack comprising a mating hole and a plurality of conducting contacts fixedly suspending in said mating hole, and two conducting terminals mounted at one side of said rack and electrically connected to said conducting contacts of said electrical socket and an internal circuit of a predetermined electronic device; and a slide cover mounted in said housing of said connector body between said oblong insertion opening and said electrical socket and slidable relative to said connector body between a received position and an extended position, said slide cover comprising a plurality of metal conducting blades affixed to one side thereof and movable with said slide cover relative to said connector body in and out of said insertion slots of said housing, said metal conducting blades each comprising a rear contact portion, the rear contact portions of said metal conducting blades being electrically connected to said conducting terminals when said metal conducting blades being movable with said slide cover out of said insertion slots of said housing.

2. The plug and socket convertible electrical connector assembly as claimed in claim 1, wherein said housing further comprises a compartment defined in a corner area in said accommodation chamber and abutted to said oblong insertion opening and said insertion slots for accommodating said rack.

3. The plug and socket convertible electrical connector assembly as claimed in claim 2, wherein said housing further comprises two sliding rails mounted in said compartment in a parallel manner; and said rack comprises two sliding grooves respectively slidably coupled to said sliding rails.

4. The plug and socket convertible electrical connector assembly as claimed in claim 1, wherein said housing further comprising a locating groove located on an inside wall thereof adjacent to one side of said oblong insertion opening; said slide cover comprises a retaining block for engaging said locating groove of said housing to hold said slide cover in said extended position.

5. The plug and socket convertible electrical connector assembly as claimed in claim 1, wherein said conducting terminals each comprise a first contact, a second contact and a third contact, the first contacts of said conducting terminals being adapted for contacting the rear contact portions of said metal conducting blades, the second contacts of said conducting terminals being electrically connected to said conducting contacts, the third contacts of said conducting terminals being electrically connected to said internal circuit of said predetermined electronic device.

6. The plug and socket convertible electrical connector assembly as claimed in claim 1, wherein said slide cover comprises a stop block protruded from an outer wall thereof and coupled to and movable along said oblong insertion opening of said housing.

7. The plug and socket convertible electrical connector assembly as claimed in claim 1, wherein said slide cover comprises a plurality of support arms extended from an inner wall thereof; said metal conducting blades are respectively affixed to and extended from said support arms, the rear contact portions of said metal conducting blades being respectively disposed adjacent to said support arms.

* * * * *